US009488026B2

(12) United States Patent
Wochner et al.

(10) Patent No.: US 9,488,026 B2
(45) Date of Patent: Nov. 8, 2016

(54) UNDERWATER NOISE ABATEMENT APPARATUS AND DEPLOYMENT SYSTEM

(71) Applicants: Mark Wochner, Austin, TX (US); Andrew McNeese, Austin, TX (US); Preston Wilson, Austin, TX (US); Kevin Lee, Austin, TX (US)

(72) Inventors: Mark Wochner, Austin, TX (US); Andrew McNeese, Austin, TX (US); Preston Wilson, Austin, TX (US); Kevin Lee, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 14/590,177

(22) Filed: Jan. 6, 2015

(65) Prior Publication Data

US 2015/0191987 A1 Jul. 9, 2015

Related U.S. Application Data

(60) Provisional application No. 61/924,015, filed on Jan. 6, 2014, provisional application No. 62/020,672, filed on Jul. 3, 2014.

(51) Int. Cl.

| | |
|---|---|
| ***E02D 13/02*** | (2006.01) |
| ***E21B 33/10*** | (2006.01) |
| ***E21B 41/00*** | (2006.01) |
| ***G10K 11/172*** | (2006.01) |
| *E02D 13/00* | (2006.01) |

(52) U.S. Cl.

CPC ..... *E21B 33/10* (2013.01); *E21B 41/0007* (2013.01); *G10K 11/172* (2013.01); *G10K 2200/11* (2013.01)

(58) Field of Classification Search

CPC ..... E02D 13/00; E02D 13/005; E02D 13/02; E02D 13/04; E02B 17/003; E02B 17/0017; E02B 41/0007

USPC ..... 181/210, 287, 295, 115

See application file for complete search history.

(56) References Cited

U.S. PATENT DOCUMENTS

| | | | | |
|---|---|---|---|---|
| 3,975,918 A * | 8/1976 | Jansz | E02D 13/00 | 173/DIG. 2 |
| 6,630,222 B1 * | 10/2003 | Fay | E04B 1/99 | 160/348 |
| 7,905,323 B2 * | 3/2011 | Larsen | G10K 11/172 | 181/286 |
| 8,342,264 B1 * | 1/2013 | Hinshaw | E21B 41/00 | 173/DIG. 2 |
| 8,387,746 B2 * | 3/2013 | Parkin | A01K 61/00 | 181/290 |
| 8,636,101 B2 * | 1/2014 | Elmer | E02B 17/0017 | 181/175 |
| 8,794,375 B2 * | 8/2014 | Jung | E02D 7/14 | 181/205 |

(Continued)

FOREIGN PATENT DOCUMENTS

| | | | |
|---|---|---|---|
| DE | 10302219 A1 * | 9/2004 | E02B 3/06 |
| DE | EP 2546829 A2 * | 1/2013 | G10K 11/16 |

(Continued)

OTHER PUBLICATIONS

ISA/US, "International Search Report for Application No. PCT/US2015/010239", Apr. 29, 2015, WIPO.

*Primary Examiner* — Edgardo San Martin

(74) *Attorney, Agent, or Firm* — Intrinsic Law Corp.; Ibrahim M. Hallaj

(57) ABSTRACT

A deployable underwater noise abatement system allowing packing and deploying an organized set of grouped resonators is disclosed. The system allows relatively compact storage and transportation of the noise abatement apparatus when not in use, then, when deployed, the apparatus can be lowered into the water and extended.

21 Claims, 21 Drawing Sheets

(56) References Cited

U.S. PATENT DOCUMENTS

| | | | | |
|---|---|---|---|---|
| 2011/0031062 | A1 | 2/2011 | Elmer | |
| 2012/0241039 | A1 | 9/2012 | Jung et al. | |
| 2013/0001010 | A1 | 1/2013 | Wilson et al. | |
| 2015/0078833 | A1* | 3/2015 | Elmer | E02D 13/00 405/195.1 |
| 2015/0170631 | A1* | 6/2015 | Wochner | E21B 41/0007 181/284 |

FOREIGN PATENT DOCUMENTS

| | | | | |
|---|---|---|---|---|
| DE | WO 2015161843 | A1 * | 10/2015 | E02D 13/005 |
| EP | 2657410 | A2 | 10/2013 | |

* cited by examiner

UNDERWATER NOISE ABATEMENT APPARATUS AND DEPLOYMENT SYSTEM

RELATED APPLICATIONS

The present application derives from and claims priority to U.S. Provisional Application No. 61/924,015, filed on Jan. 6, 2014, bearing the present title, and U.S. Provisional Application No. 62/020,672, filed on Jul. 3, 2014 entitled "Underwater Noise Abatement Apparatus with Simple Multi-Frequency Responsive Resonator Elements", both of which are hereby incorporated by reference.

TECHNICAL FIELD

The present disclosure relates to the deployment of noise abatement devices for reduction of underwater sound emissions, such as noise from sea faring vessels, oil and mineral drilling operations, and marine construction and demolition.

STATEMENT REGARDING JOINT RESEARCH AGREEMENT

One or more inventions contained in this application were developed under a joint research agreement between The University of Texas at Austin and AdBm Technologies, LLC.

BACKGROUND

Various underwater noise abatement apparatuses have been proposed. Some are embodied in a form factor that encloses or is deployed at or near a source of underwater noise. Patent publication US 2011/0031062, entitled "Device for damping and scattering hydrosound in a liquid," describes a plurality of buoyant gas enclosures (balloons containing air) tethered to a rigid underwater frame that absorb underwater sound in a frequency range determined by the size of the gas enclosures. Patent application Ser. No. 14/572,248, entitled "Underwater Noise Reduction System Using Open-Ended Resonator Assembly and Deployment Apparatus," discloses systems of submersible open-ended gas resonators that can be deployed in an underwater noise environment to attenuate noise therefrom. These and their related applications and documentation are incorporated herein by reference.

Underwater noise reduction systems are intended to mitigate man-made noise so as to reduce the environmental impact of this noise. Pile driving for offshore construction, oil and gas drilling platforms, and sea faring vessels are examples of noise that can be undesirable and that should be mitigated. However, the installation, deployment and packaging of underwater noise abatement systems can be challenging, as these apparatus are typically bulky and cumbersome to store and deploy.

The present application is concerned with the packaging, storage, and deployment of underwater noise reduction devices.

SUMMARY

A deployment system for packing and deploying underwater noise reduction apparatus is disclosed. The system allows relatively compact storage and transportation of the noise abatement apparatus when not in use, then, when deployed, the apparatus can be lowered into the water and extended.

In an aspect, the system comprises a plurality of noise abating resonators, each resonator holding a gas therein and being responsive to acoustic energy in a vicinity of said resonator. The resonators are arranged into a deployable arrangement within a collapsible frame so that the deployable arrangement provides a deployed configuration of the resonators in the frame when the system is deployed, and a stowed configuration of the resonators in the frame when the system is not deployed. In the deployed configuration, the frame is in an extended position so that the resonators are spaced further apart from one another than they would be when stowed, and in the stowed configuration the frame is in a contracted position so that the resonators are spaced closer together than they would be when deployed.

In another aspect, a method for abating noise is disclosed. The method includes arranging a plurality of acoustic resonators in a flexible and deployable framework that can be configured in a deployed or in a stowed configuration. The method also includes extending the frame into its deployed configuration by extending the flexible frame when the framework is to be deployed into a volume in which noise is to be abated. The method also includes contracting the frame into its stowed configuration by compacting the flexible frame when the framework is to be stowed. The method also includes storing the deployable framework in a storage compartment when not deployed and when in its stowed configuration.

IN THE DRAWINGS

For a fuller understanding of the nature and advantages of the present concepts, reference is made to the following detailed description of preferred embodiments and in connection with the accompanying drawings, in which.

DETAILED DESCRIPTION

A plurality of noise-reducing resonators are disposed on a collapsible frame. The collapsible frame can be configured in a stowed arrangement and a deployed arrangement. In the stowed arrangement, the space between each resonator is reduced compared to the deployed arrangement. In the deployed arrangement, the space between each resonator is increased compared to the stowed arrangement. The resonators can be arranged in a two- or three-dimensional array. A rigging line can be used to transition the frame from/to the stowed arrangement to/from the deployed arrangement. The rigging line can be connected to a winch.

Figure 1:
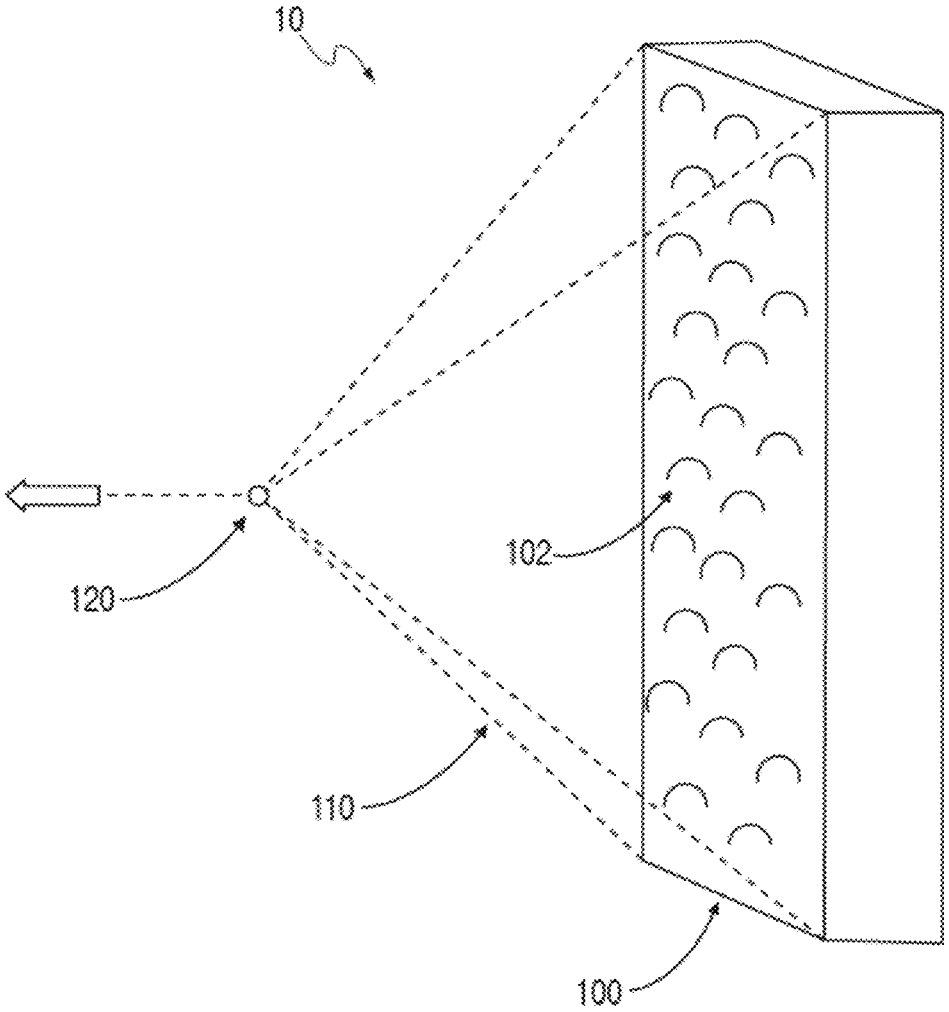
FIG. 1 illustrates an exemplary noise reduction apparatus panel.

FIG. 1 illustrates an underwater noise reduction apparatus 10. The noise reduction apparatus 10 can be lowered into a body of water around or proximal to a noise-generating event or thing such as a drilling platform, ship, or other machine. A plurality of resonators 102 on a panel 100 of the noise reduction apparatus 10 resonate so as to absorb sound energy and therefore reduce the radiated sound energy emanating from the location of the noise-generating event or thing. The resonators 102 include a cavity to retain a gas, such as air, nitrogen, argon, or combination thereof in some embodiments. For example, the resonators 102 can be the type of resonators disclosed in U.S. Ser. No. 14/494,700, entitled "Underwater Noise Abatement Panel and Resonator Structure," which is hereby incorporated herein by reference. In some embodiments, the resonators 102 are arranged in a two- or three-dimensional array.

In the shown embodiment, the panel 100 is towed by lines 110 tethered to a tow point or line 120. As an example, the apparatus can be towed behind a noisy sea faring vessel. Several such apparatuses can be assembled into a system for reducing underwater noise emissions from the vessel. Also, a system like this can be assembled around one or more facets of a mining or drilling rig.

Figure 2:
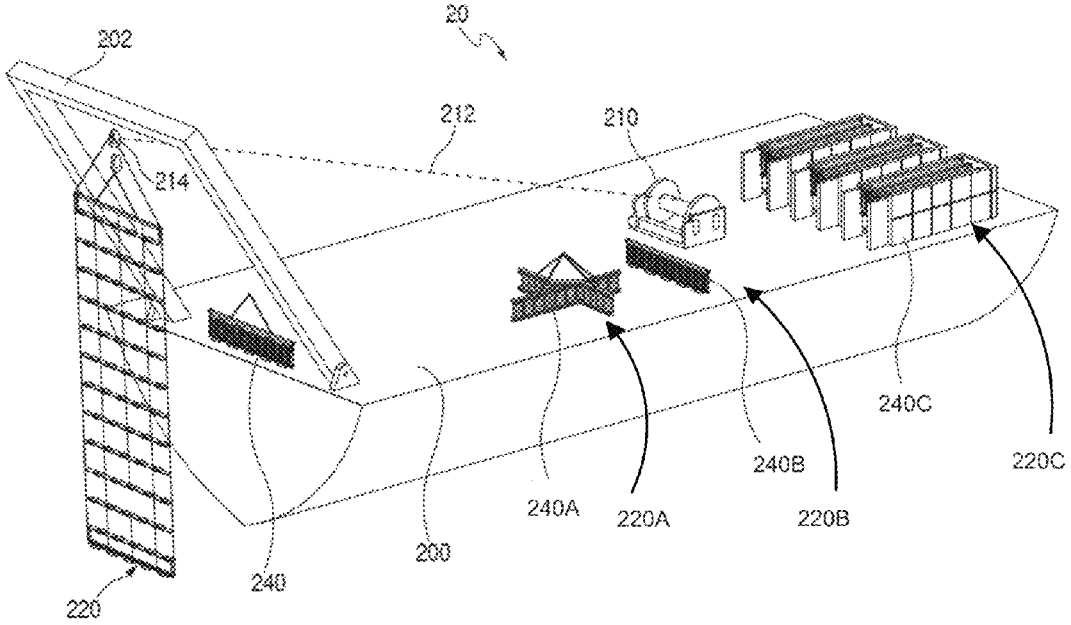
FIG. 2 illustrates a vessel carrying and deploying a noise reduction apparatus.

FIG. 2 illustrates an exemplary sea faring vessel (e.g., a ship) 20 equipped to deploy a noise reducing apparatus 220 into the water. The ship 20 has a deck 200 and an articulated structural support member 202 at one end thereof. It is understood that the present example is but for the sake of illustration, and other embodiments and arrangements will be apparent to those skilled in the art.

The noise reducing apparatus 220 is expandable and deployable as described below. Using a line 212, the noise reducing apparatus 220 can be lowered into and raised out of the water using a winch 210 and pulley 214. The example illustrates a number of noise reducing apparatuses 220A, 220B, 220C in their standby, collapsed, and stowed configurations 240A, 240B, 240C, respectively. The crew of the ship can attach, hoist, and deploy the noise reducing apparatus 220 into the water as desired.

Figure 3:
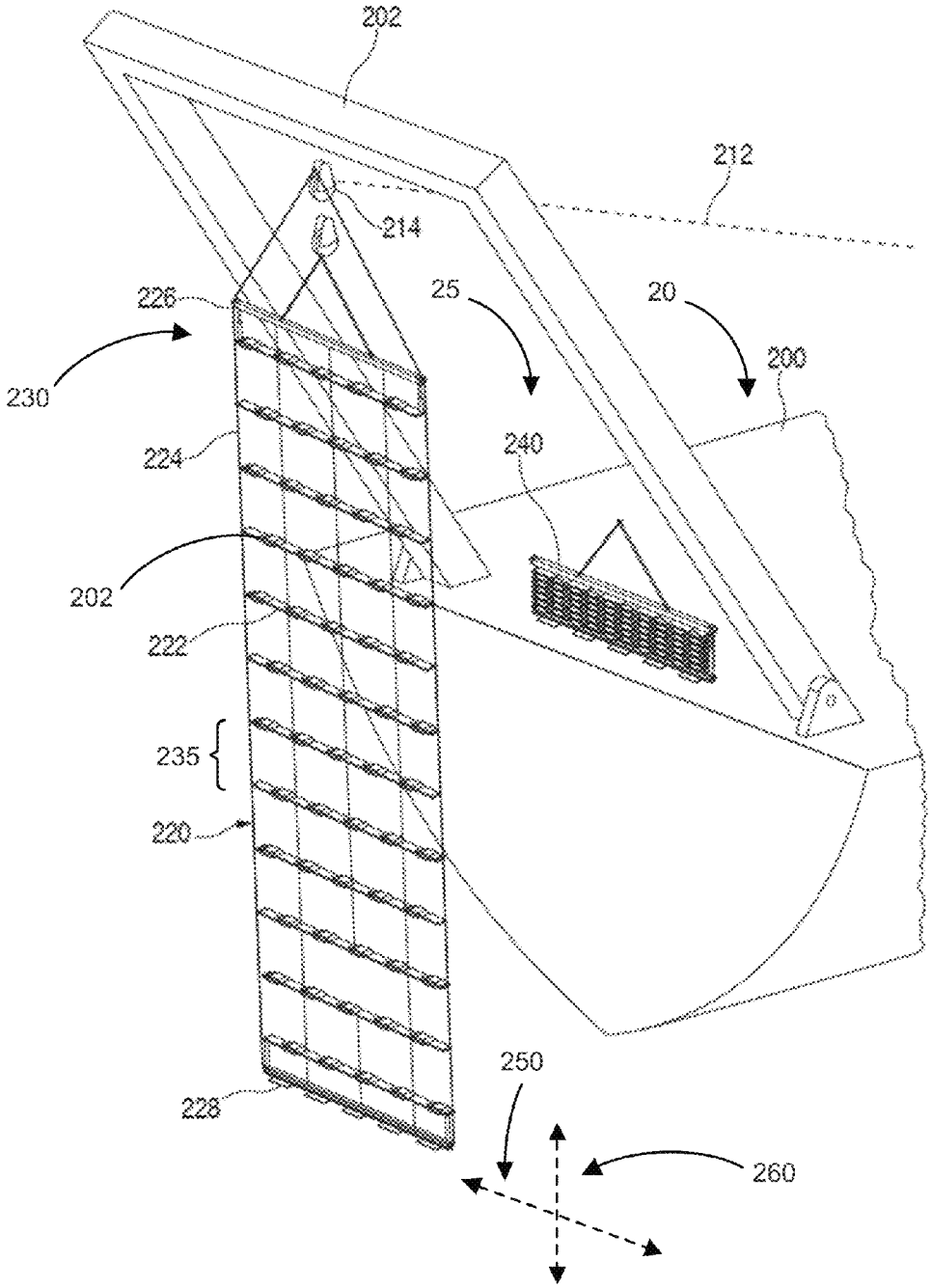
FIG. 3 illustrates a detail of FIG. 2.

FIG. 3 shows a closer detail of the aft section 25 of vessel 20. We see that line 212 can be used to raise and lower noise reduction apparatus 220. The apparatus 220 drops under the weight of gravity. A plurality of rows 222 of resonators 202 are configured as shown so that they are flexibly coupled by rigging lines 224 allowing them to change from stowed (e.g., compact and folded) format 240 to an open format 220 when deployed. In the open format 220, the rows 222 are spaced apart from one another at a predetermined distance 235 based on the length of rigging lines 224 between each row 222. A top bar 226 can be made of metal with a buoyant material, such as a hard syntactic foam, attached thereto. This keeps a top portion 230 of the apparatus 220 separated and above lower cross member 228 to extend the rigging lines 224 so they are generally taut and the rows 222 spaced apart as discussed above.

As illustrated, the rows 222 are generally parallel with one another. The rows 222 generally extend along a first dimension 250, which can be parallel to a surface of the ocean. The resonators 202 are also disposed in columns 226, which generally extend in a second dimension 260. The second dimension 260 can be generally orthogonal (e.g., within about 10%) to the first direction 250. The second dimension 260 can be generally parallel (e.g., within about 10%) to the direction of gravitational pull.

Figure 4:
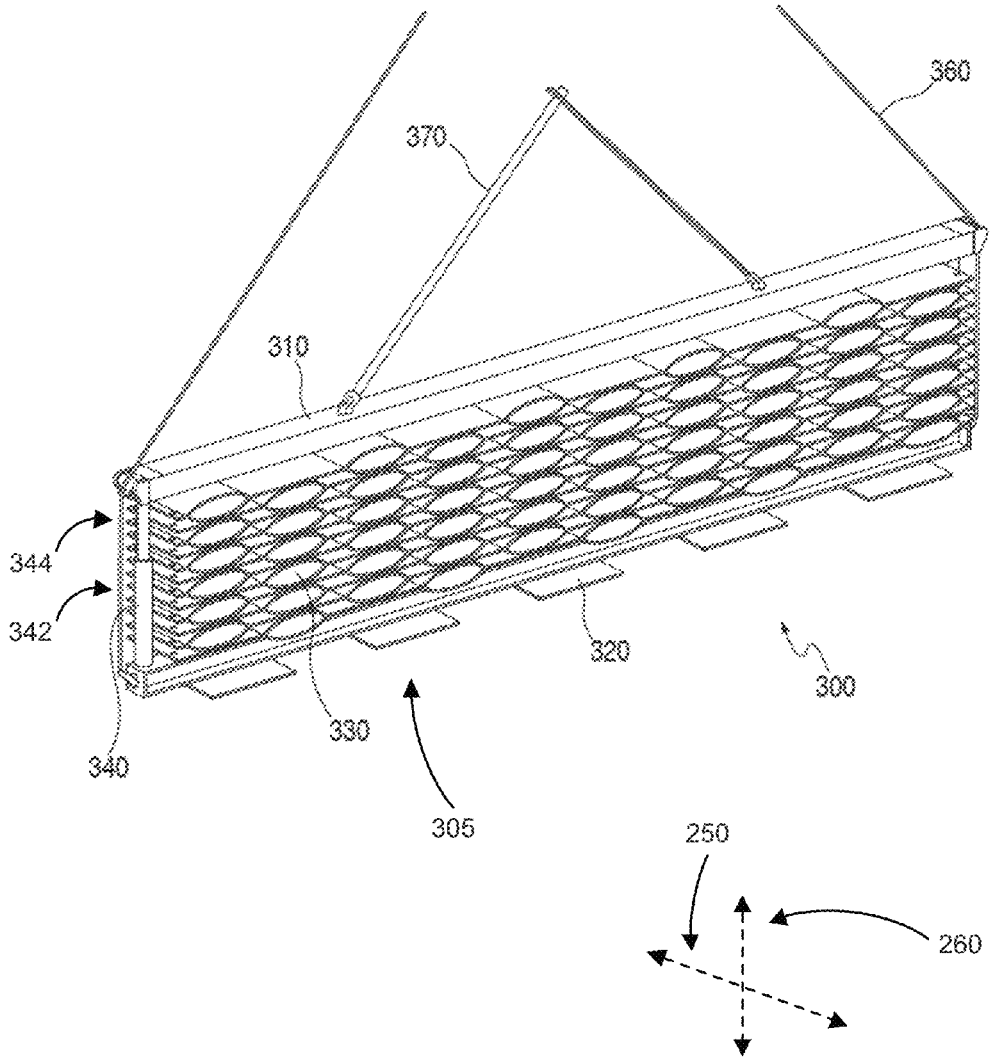
FIG. 4 illustrates a noise reduction apparatus panel in its stowed configuration.

FIG. 4 illustrates an exemplary noise reduction apparatus 300 in its stowed (compact and folded) configuration 305. This configuration 305 takes up less space in the second dimension 260 (e.g., the vertical direction) to store the apparatus 300 and to make it easier to transport and/or to stack with other similar units in transit or storage. Upper cross member 310 is shown, and as mentioned above, can be constructed of metal with a buoyant material such as foam attached. Lower cross member 320 may be constructed of a metal material. In general, the metal material should be resistant to corrosion that would result from exposure to the ocean. Examples of such materials are stainless steel, aluminum, bronze, and combinations thereof. The metal material can also be comprised of something susceptible to corrosion such as steel, but treated with a galvanizing process, a powder coating, or the like.

Optional telescoping side support members or struts 340 can permit collapsing and expanding of the overall structure along the second dimension 260 (e.g., the vertical direction). The telescoping side support members 340 include a female portion 342 and a male portion 344. The female portion 342 includes a cavity to receive the male portion 344. The female and male portions 342, 344 can slideably engage in a telescoping manner as the apparatus 300 expands from the stowed configuration 360 to a deployed configuration (e.g., as illustrated in FIG. 3). In the stowed configuration 360, at least a portion of the male portion 344 is disposed in the female portion 342.

Support lines 370 can hoist the apparatus 300 up and down (e.g., along the second dimension 260) while lines 360 allow the expansion and collapsing of the apparatus similar to a venetian blind. The "blinds" or "slats" 330 of the apparatus 300 may consist of a plurality of resonators in the form of inflatable pockets or compartments. In some embodiments the resonators are inverted open ended (having a downward facing open 'mouth') to hold a quantity of air or other gas in each resonator, as discussed above. The resonators can act as Helmholtz resonators to absorb underwater sound when deployed. In an embodiment, the resonators may include a conductive fluid-permeable mesh over the open end thereof that improves the noise absorption capabilities of the system through heat transfer associated with the resonance of gas in the resonators.

Figure 5A:
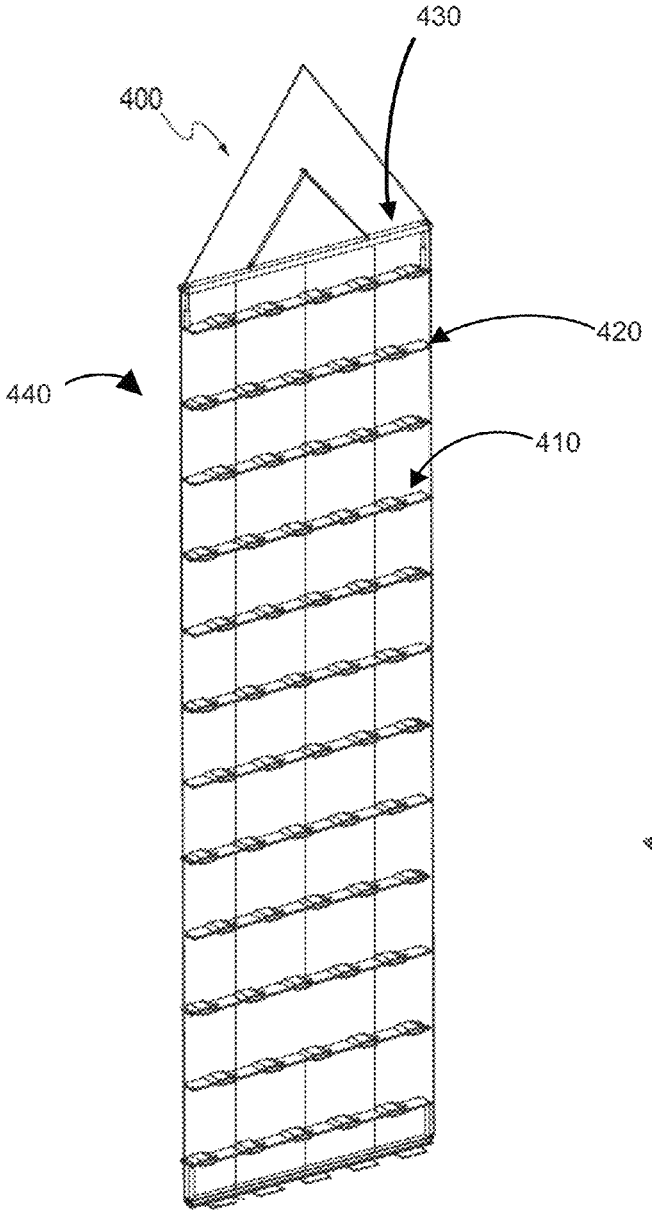
FIG. 5A illustrates a perspective view of the panel of FIG. 4 in its deployed configuration.

FIG. 5A shows an extended noise absorbing apparatus panel 400 as it would appear when deployed. It is clear that an essentially arbitrary number of resonators 410 can be arranged in resonator rows 420 of the apparatus panel 400. The spacing and configuration of the resonators 410 can be flexibly designed according to the needs of the user of the apparatus 400. The resonators 410 can be arranged in an array of rows 420 and columns 430 as illustrated. The rows 420 and columns 430 generally define a plane 440.

Figure 5B:
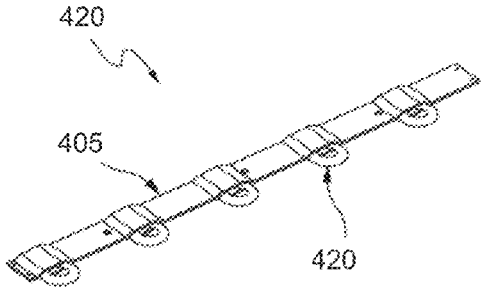
FIG. 5B illustrates a perspective view of a row of resonators disposed in the apparatus of FIG. 5A.

FIG. 5B illustrates an exemplary configuration of resonators 410 (e.g., inflatable members) arranged in rows 420 of the apparatus of FIG. 5A in a fabric or rubber or other mesh or flexible belt strip 405. The strip 405 can support the resonators 410 so they stay aligned generally in the row 420.

Figure 6:
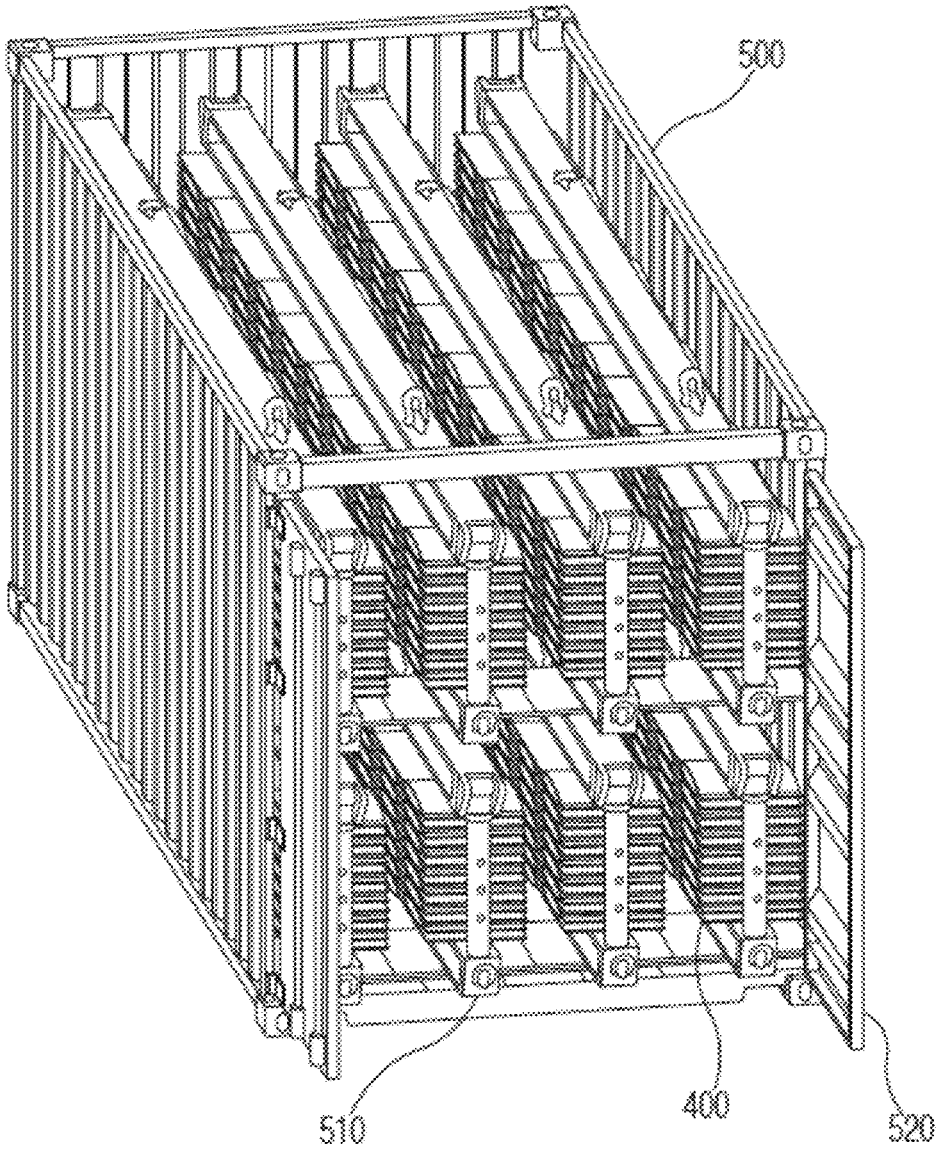
FIG. 6 illustrates storage and transportation of a noise reduction apparatus.

FIG. 6 illustrates an exemplary way to stow and transport a plurality of noise absorbing resonator panels 400, such as those described above, in a standard shipping container 500. The roof of the container 500 is not illustrated in the drawing for clarity. A system of shelves or racks 510 support the folded noise absorbing apparatus panels 400 in the container 500. The container 500 has doors 520 that can be opened to access its interior as known in the art. The panels 400 can be retracted using a translation device, forklift or other material handling device. In some embodiments, the container 500 has a removable top or roof. Once the top or roof is removed, upper panels 400 can be lifted out (e.g., with a crane).

Figure 7A:
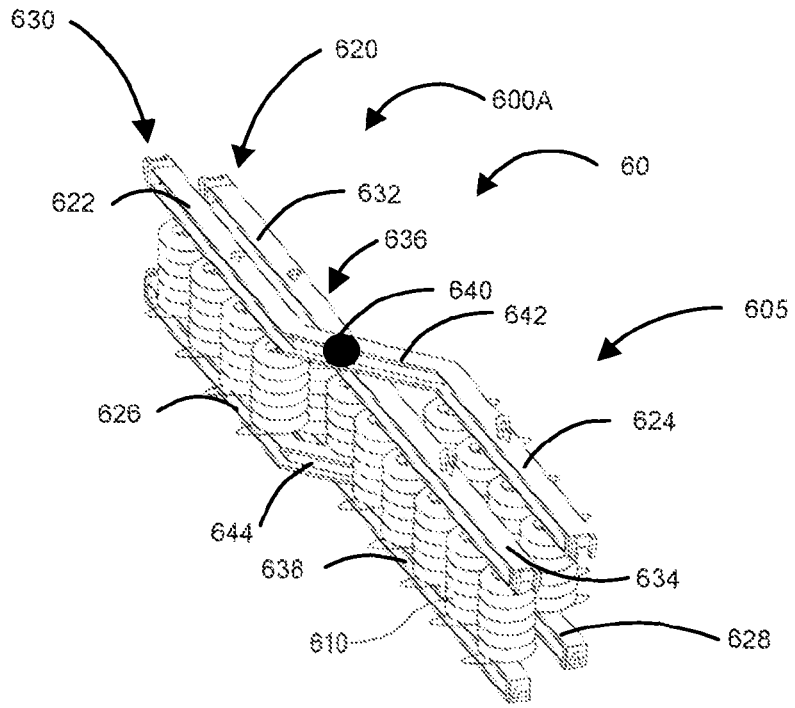
FIG. 7A illustrates a collapsed configuration of a noise reduction apparatus.
Figure 7B:
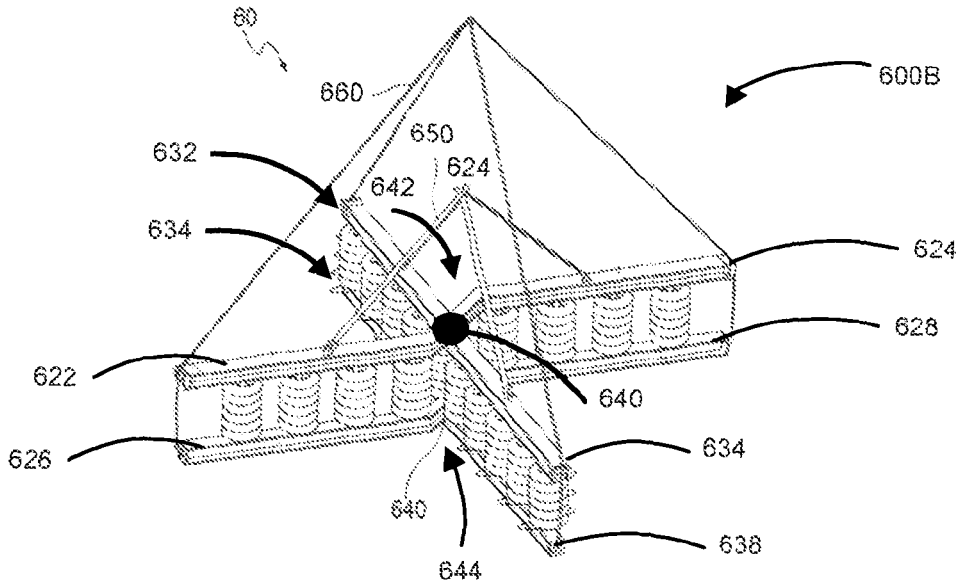
FIG. 7B illustrates an-expanded configuration of a noise reduction apparatus.

FIG. 7A and FIG. 7B illustrate another exemplary noise absorbing apparatus or unit 60 that can be used in the present context. FIG. 7A shows the apparatus 600A in its stowed or folded configuration. The apparatus 600A includes a frame 605 having a first support arm 620 and a second support arm 630. The first and second support arms 620, 630 can pivot with respect to one another on a hinge 640 similar to scissors. The first support arm 620 includes first upper support members 622, 624 and first lower support members 626, 628. The second support arm 630 includes second upper support members 632, 634 and second lower support members 636, 638. As illustrated, upper and lower angled members 642, 644 on the first support arm 620 integrally connect the first upper support members 622, 624 and the first lower support members 626, 628, respectively. The angled members 642, 644 are configured to provide a more compact arrangement of the first and second support arms 620, 630. With the angled members 642, 644, the first upper support members 622, 624 are generally parallel to the second upper support members 632, 634 in the stowed or folded configuration. Similarly, with the angled members 642, 644, the first lower support members 626, 628 are generally parallel to the second lower support members 636, 638 in the stowed or folded configuration. This configuration is similar to scissors when they are closed shut.

A plurality of resonators 610 (e.g., inflatable bladders or tubes or inverted cup resonators) can be supported by the first and second support arms 620, 630. FIG. 7B illustrates the apparatus 600B in its opened configuration, similar to scissors when they are wide open. When opened as in FIG. 7B the apparatus 600B is still not in its fully extended (deployed) configuration. Support line 650 can be used to carry the apparatus, and deployment lines 660 can permit the apparatus to be fully deployed and retracted. The first upper support members 622, 624 and/or the second upper support member 632, 634 can include a flotation material such as a foam or syntactic foam that causes the upper support members to float above the lower support members.

Figure 8:
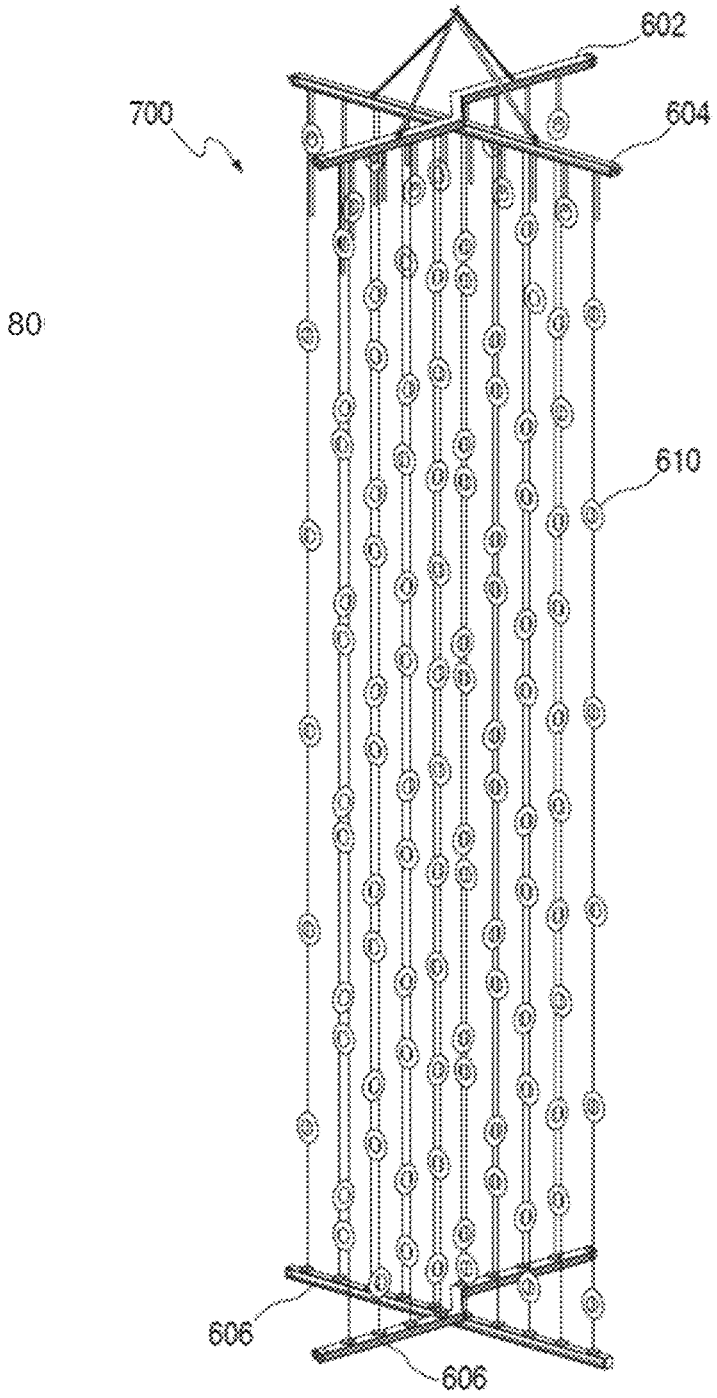
FIG. 8 illustrates the apparatus of FIGS. 7A and 7B in its fully deployed configuration.

FIG. 8 illustrates the noise reduction apparatus 80 of the previous drawings in a fully deployed configuration 800. Upper support arms 602, 604 are above the lower support arms 606, 608. The resonators 610 are coupled to riggings, flexible lines, fabric, or similar flexible support members 820, which extend from the upper support arms 602, 604 to the lower support arms 606, 608. The support members 820 can define rows and/or columns of resonators 610 in the apparatus 80.

Figure 9:
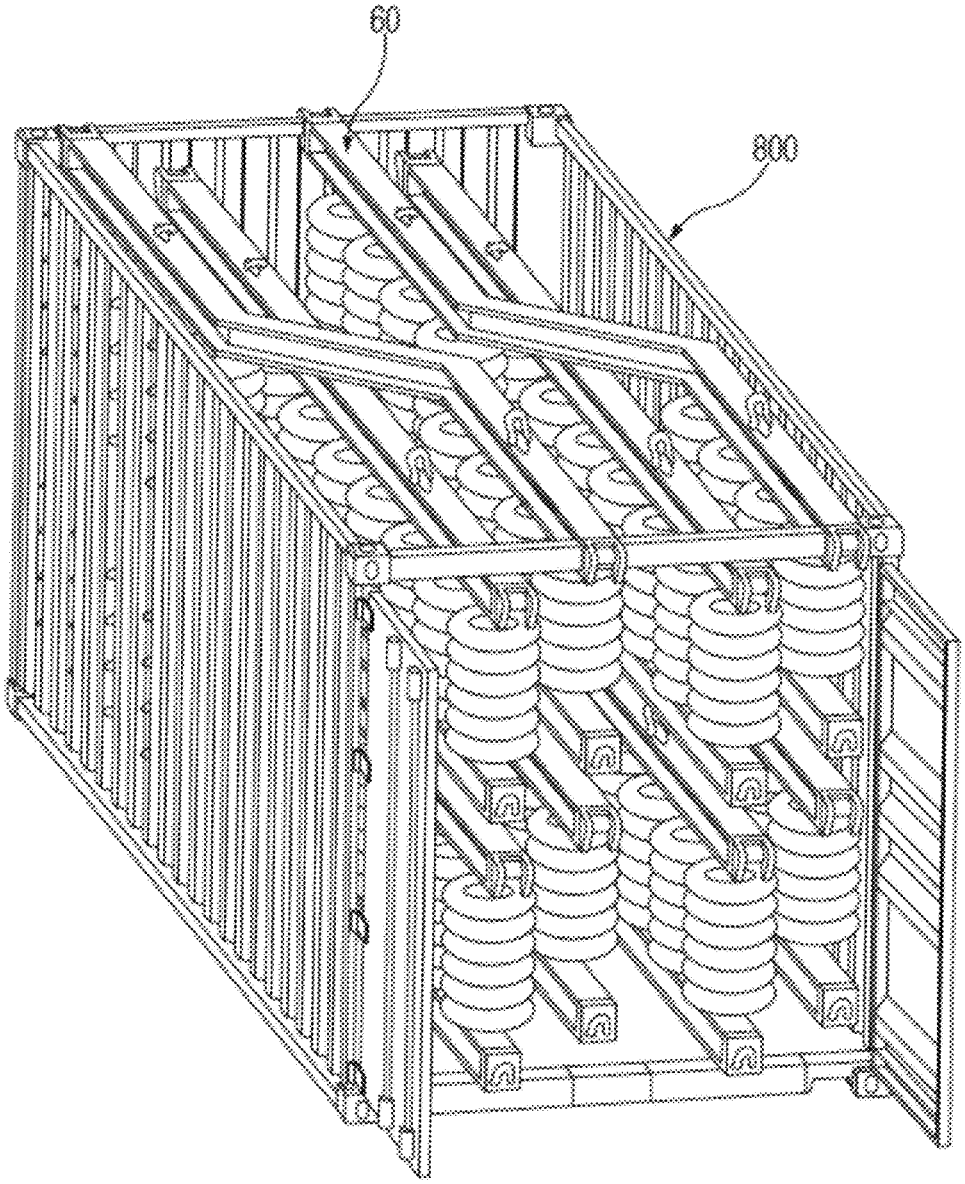
FIG. 9 illustrates storage and transportation of the apparatus of FIG. 8.

FIG. 9 illustrates storage and transportation of the noise reduction apparatus of FIGS. 7A, 7B, and 8. Once stowed and collapsed in its vertical dimension, the scissor-like arms are also collapsed to that configuration of FIG. 7A. Then, a plurality of such units 60 can be stowed on racks, rails or hooks in a shipping container 800.

Figure 10A:
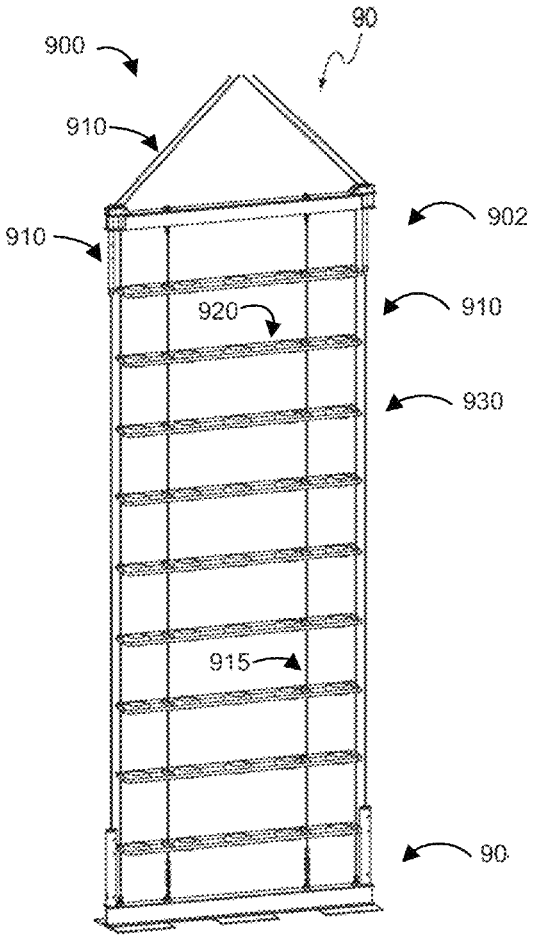
FIG. 10A illustrates a perspective view of a self-collapsing noise reduction apparatus that expands and retracts when deployed or stowed.
Figure 10B:
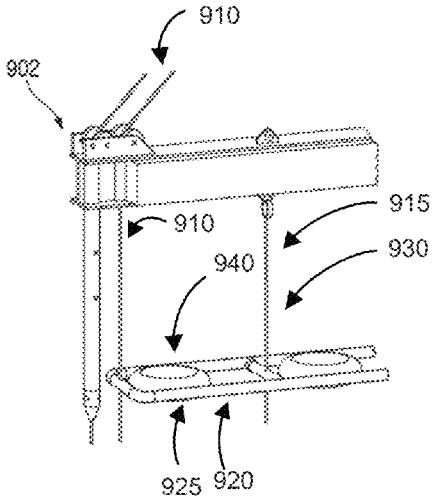
FIG. 10B illustrates a perspective view of an upper portion of a self-collapsing noise reduction apparatus.
Figure 10C:
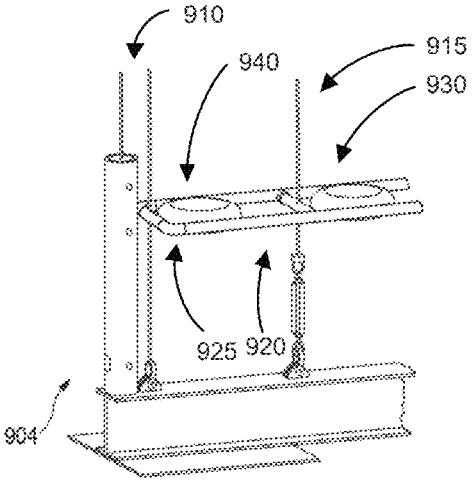
FIG. 10C illustrates a perspective view of a lower portion of a self-collapsing noise reduction apparatus.
Figure 11:
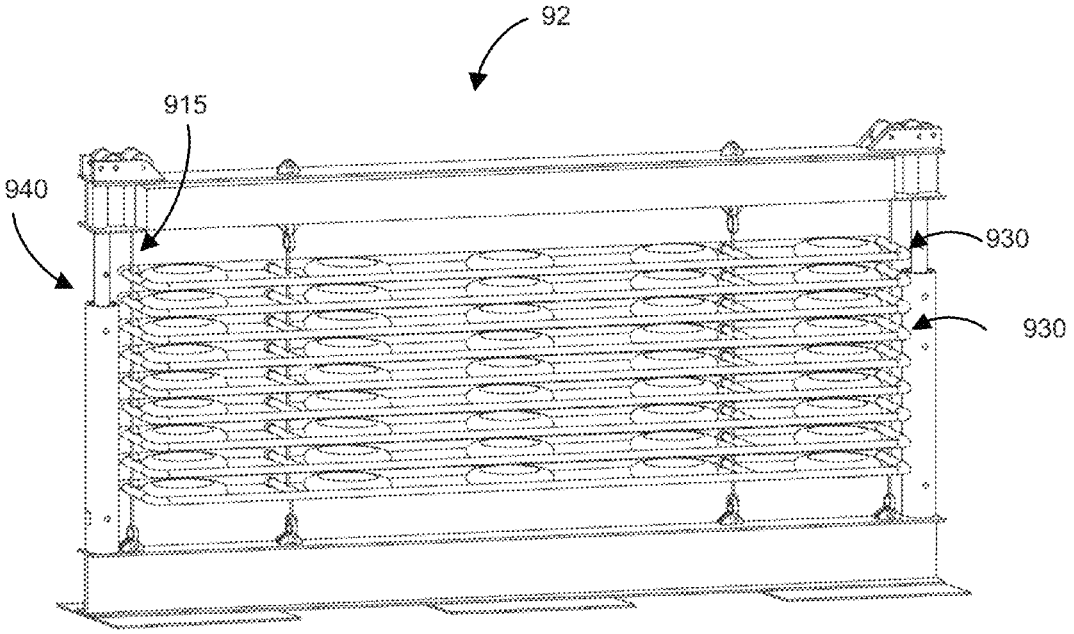
FIG. 11 illustrates a perspective view of a self-collapsing noise reduction apparatus in a stowed configuration.

FIGS. 10A-C illustrate another embodiment of the present deployable noise reduction apparatus 90. In FIG. 10A, the apparatus 90 is shown in an open/deployed configuration 900. The upper portion 902 and lower portion 904 of the apparatus are shown in detail at FIGS. 10B and 10C, respectively. In this arrangement, a separate winch is not required to collapse the apparatus 90. Instead, the act of lowering the apparatus 90 into the water will cause it to deploy under the force of gravity, and the act of drawing the apparatus 90 up out of the water will cause the apparatus 90 to fold upon itself to a compact folded or collapsed configuration 92 (as illustrated in FIG. 11). Deployment lines 910 connect the upper portion 902 to the lower portion 904 to allow the expansion and collapsing of the apparatus 90 similar to a venetian blind. The deployment lines 910 can be connected to a winch, so the same deployment lines can be used to raise/lower the apparatus 90 and to "open" the venetian blinds. Thus, a single winch or deployment cable system can be used on this embodiment.

A support member 920 is disposed across each row 930. The support member 920 includes a frame 925 for supporting resonators 940. In some embodiments, the frame 925 is rigid or semi-rigid (e.g., a plastic, rubber, or metallic material). Vertical lines 915 connect the support members 920 to upper and lower cross members 950, 960.

FIG. 11 illustrates the collapsed noise reduction apparatus 92 as it would look before it is deployed, for example on the deck of a ship or in the storage holds. In the collapsed configuration, the vertical lines 915 are flexed so the rows 930 are collapsed on to each other. This is similar to a venetian blind when it is opened to expose a window. The apparatus 92 includes a telescoping side support member 940, as described above.

Figure 12A:
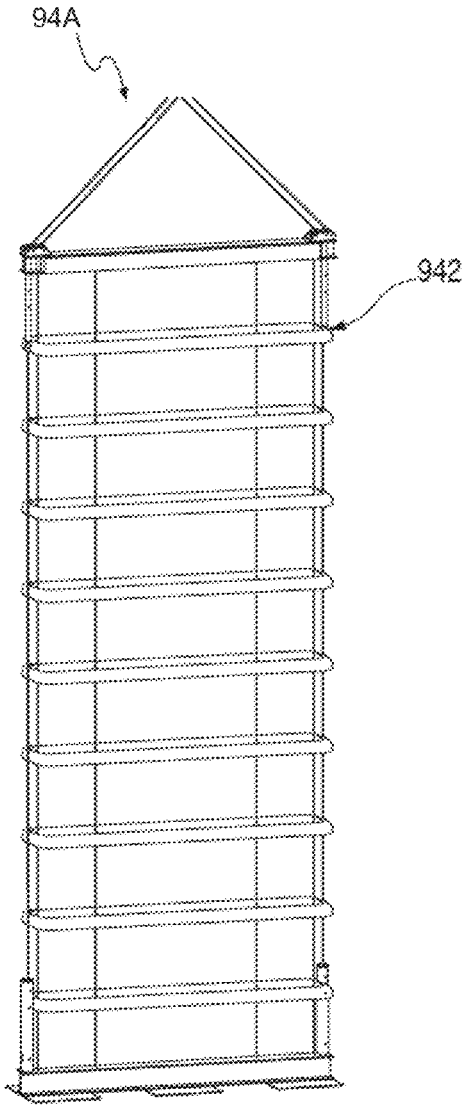
FIG. 12A illustrates a first perspective view of a self-collapsing noise reduction apparatus in a deployed configuration.
Figure 12B:
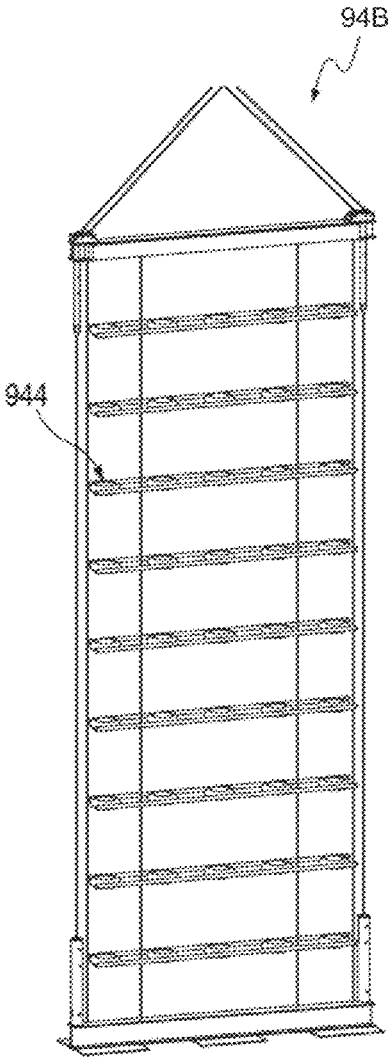
FIG. 12B illustrates a second perspective view of a self-collapsing noise reduction apparatus in a deployed configuration.

FIGS. 12A and 12B illustrate two exemplary views of noise reduction apparatuses 94A, 94B, respectively, in its deployed or extended configuration. Note that a variety of types of resonators 942, 944 can be employed in such a system without loss of generality. The apparatuses 94A, 94B generally correspond to the apparatus 92 of FIG. 11.

Figure 13A:
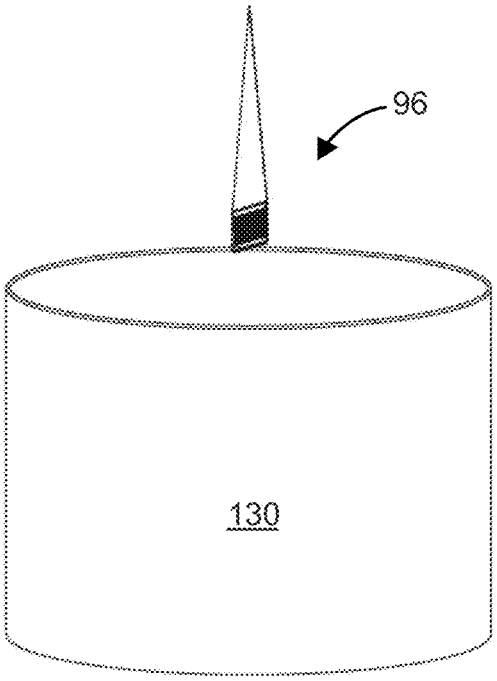
FIG. 13A illustrates a perspective view of a self-collapsing noise reduction apparatus in a stowed configuration before deployment in a water tank.
Figure 13B:
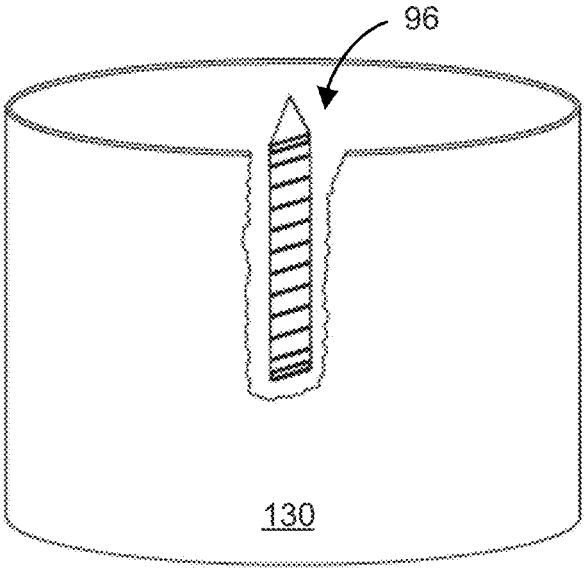
FIG. 13B illustrates a perspective view of a self-collapsing noise reduction apparatus in a deployed configuration after deployment in a water tank.

FIGS. 13A and 13B illustrate two views of self-stowing noise reduction apparatus 96. In FIG. 13A the apparatus is in its collapsed or stowed configuration (e.g., before or after deployment into a water body or tank 1300). In FIG. 13B the apparatus is in its extended or deployed configuration (e.g., while in use in the water).

Figure 14A:
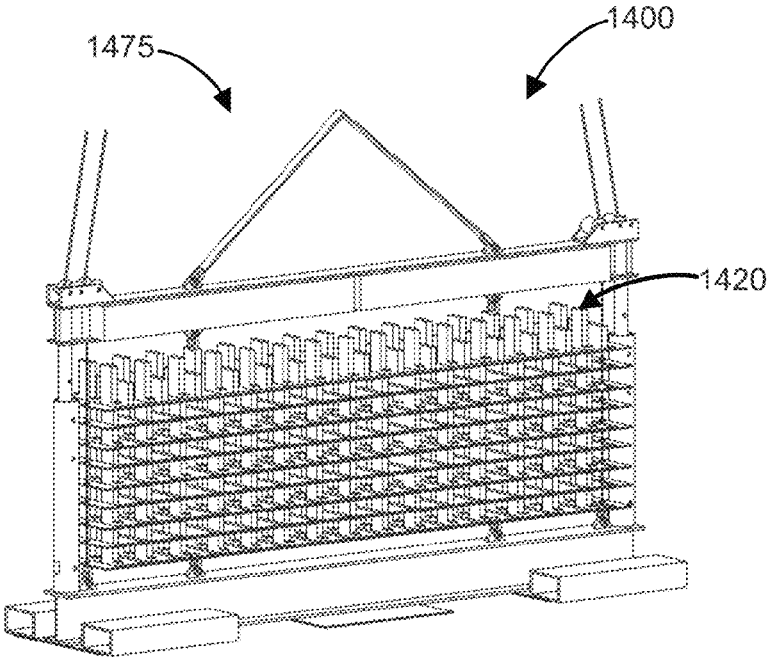
FIG. 14A illustrates a perspective view of a noise reduction apparatus in a deployed configuration.
Figure 14B:
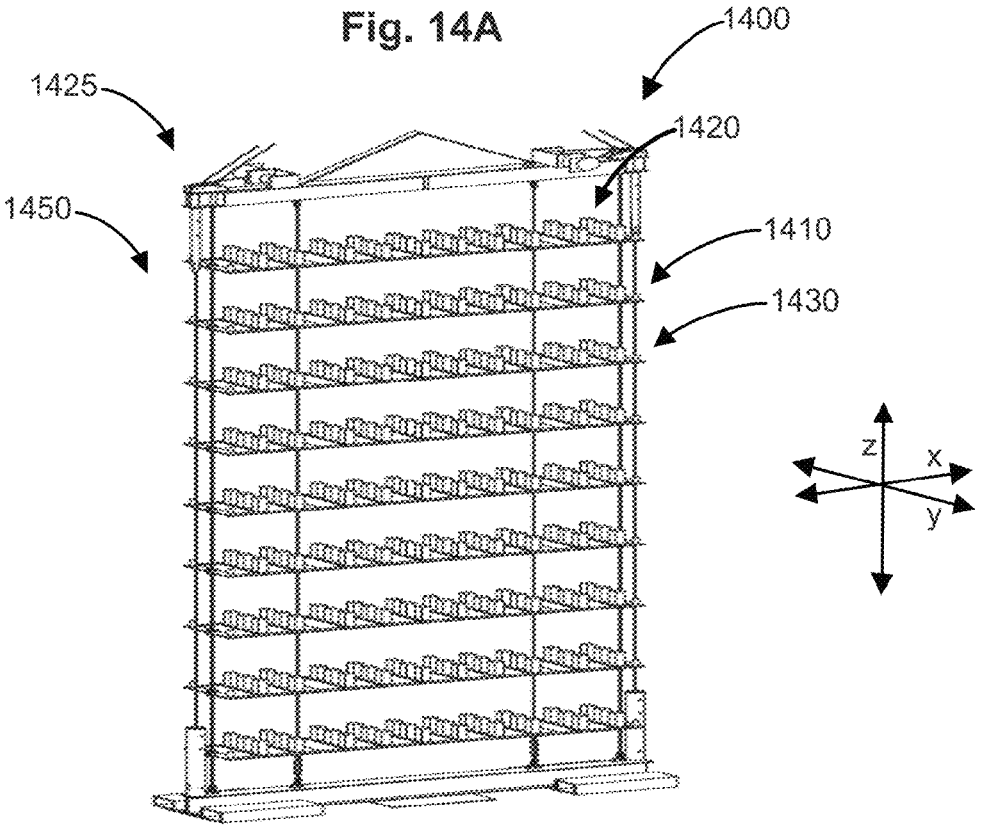
FIG. 14B illustrates a perspective view of a noise reduction apparatus in a stowed-configuration.

FIGS. 14A and 14B illustrate an embodiment of a deployable noise reduction apparatus 1400. The apparatus includes a three-dimensional array of resonators 1410 arranged in the x, y, and z directions. For example, the resonators 1410 are disposed in columns 1420 and rows 1430. The rows 1430 have a width and a depth in the x and y directions, respectively, which define a plane. The apparatus 1400 is illustrated in a deployed configuration 1425 in FIG. 14A and a collapsed or storage configuration 1475 in FIG. 14B. By adding a third dimension to the array of resonators 1410, a greater number of resonators 1410 can be deployed on a panel 1450 and, thus, a greater noise absorption can be accomplished by the apparatus 1400.

Figure 15A:
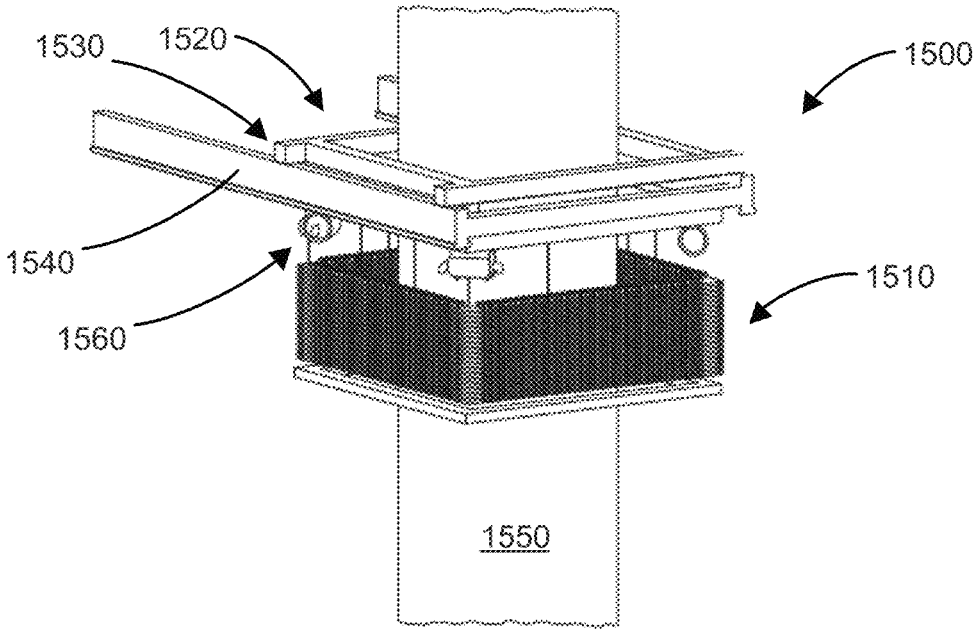
FIG. 15A illustrates a perspective view of a noise reduction apparatus in stowed configuration connected to a support frame.
Figure 15B:
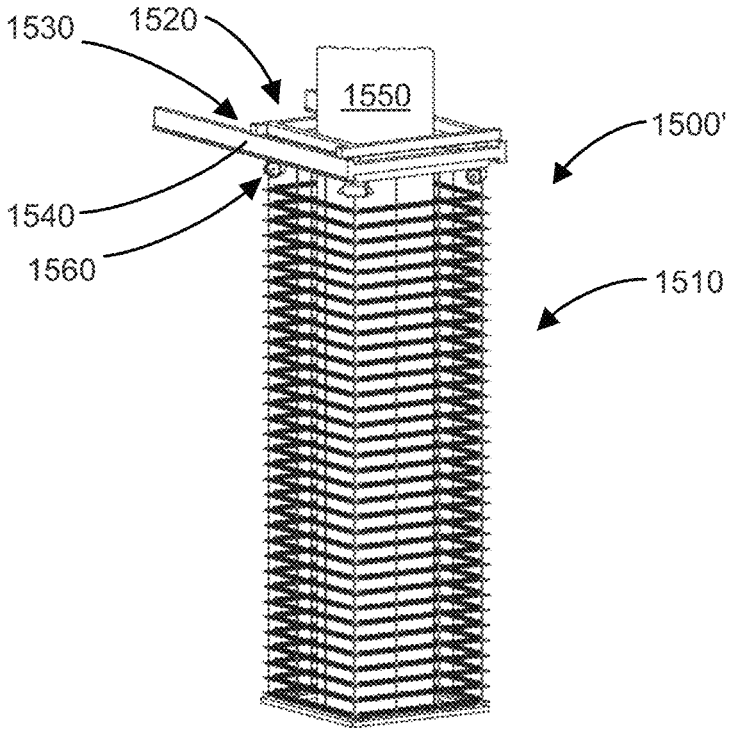
FIG. 15B illustrates a perspective view of a noise reduction apparatus in a deployed configuration connected to a support frame.
Figure 16A:
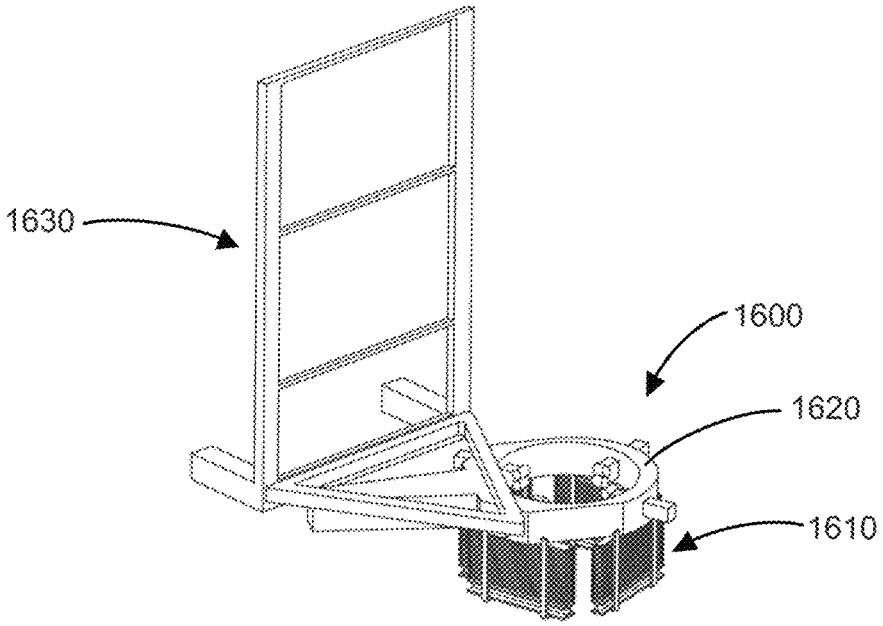
FIG. 16A illustrates a noise reduction apparatus in a stowed configuration mounted on an annular articulating frame in a lowered position.
Figure 16B:
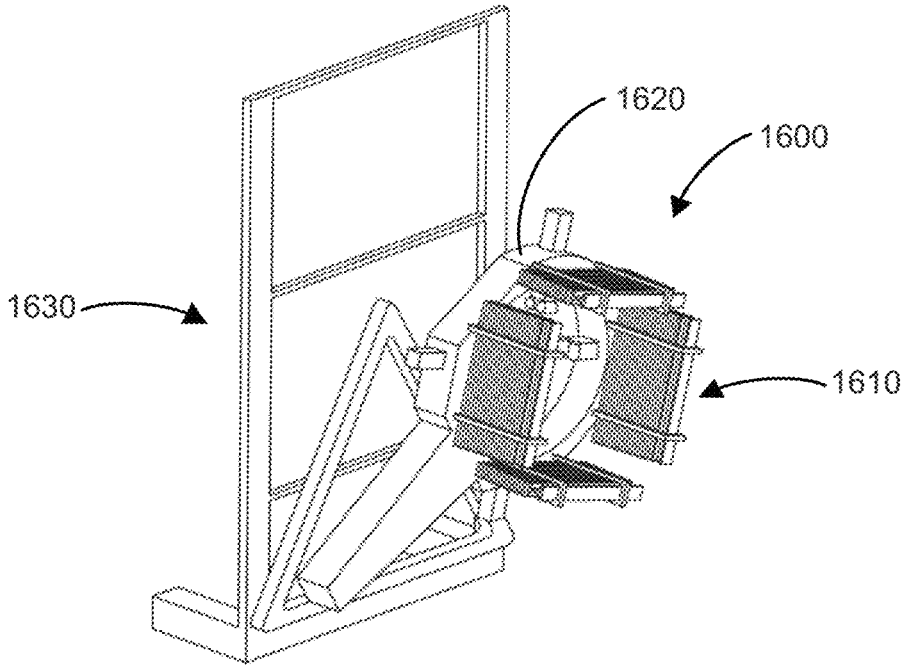
FIG. 16B illustrates a noise reduction apparatus in a stowed configuration mounted on an annular articulating frame in a raised position.
Figure 16C:
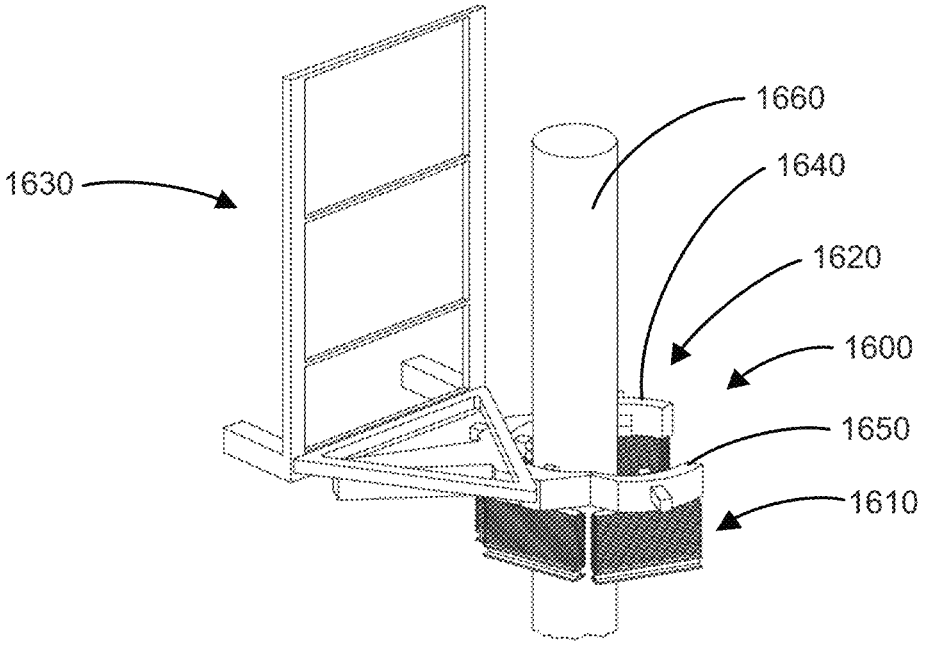
FIG. 16C illustrates the noise reduction apparatus of FIG. 16B on an annular articulating frame in an open position for mounting on a pile.
Figure 16D:
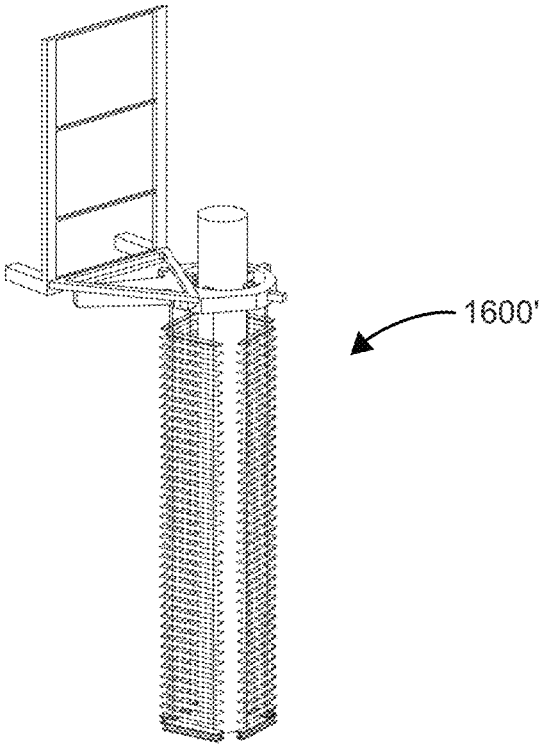
FIG. 16D illustrates the noise reduction apparatus of FIG. 16C in a deployed configuration while the annular articulating frame is mounted on the pile.

FIGS. 15A and 15B illustrate a noise reduction system 1500 formed of four noise reduction panels 1510. Each panel 1510 is suspended from a frame 1520. The frame 1520 includes overhangs 1530 for hanging the frame 1520 on a pile gripper 1540, which is attached to a pylon or a pile (e.g., a pile driving steel pipe) 1550 or other support structure. For efficiency, the term pylon is used in this and other paragraphs to refer to such structures. The pylon 1550 can be a portion of an offshore wind turbine foundation or similar apparatus. The frame 1520 including the panels 1510 can be placed on the pile gripper 1540 with a crane or similar machine.

One or more winches 1560 are connected to the panels 1510 to raise/lower the system 1500 from a collapsed or storage configuration, as illustrated in FIG. 15A, to a deployed configuration 1500', as illustrated in FIG. 15B. Each panel 1510 can raise/lower like a venetian blind, as discussed above. In some embodiments, a single winch 1560 is used to raise/lower the system 1500 so that the panels 1510 are raised/lowered at the same time. Alternatively, multiple winches 1560 can be used and they can be synchronized with a central control system.

FIGS. 16A-D illustrate a deployable noise reduction apparatus 1600 comprising four noise reduction panels 1610 mounted on an annular articulating stowable frame 1620. In some embodiments, the noise reduction panels 1610 are rigidly and/or securely mounted on the annular frame 1620. The annular frame 1620 is connected to a secondary frame 1630, which can be mounted on a ship. The annular frame 1620 can pivot vertically from a lowered position (FIG. 15A) to a raised position (FIG. 15B). In addition or in the alternative, the annular frame 1620 can pivot horizontally. The rigid and/or secure mounting of the panels 1610 on the annular frame 1620 allows the annular frame 1620 to pivot while the panels 1610 are mounted on the annular frame 1620. As illustrated in FIG. 15C, a first arm 1640 and a second arm 1650 of the annular frame 1620 can open like a claw to receive a pylon 1660 or other support structure inside the annular frame 1620. After the pylon 1660 is inside the annular frame 1620, the first and second arms 1640, 1650 can close to mount the annular frame 1620 on the pylon 1660. The noise reduction panels 1610 are then lowered into a deployed configuration 1600' (FIG. 15D) as discussed above. The noise reduction apparatus 1600 provides an efficient structure for reducing noise proximal to a jackup rig or other vessel that includes a pylon.

Figure 17A:
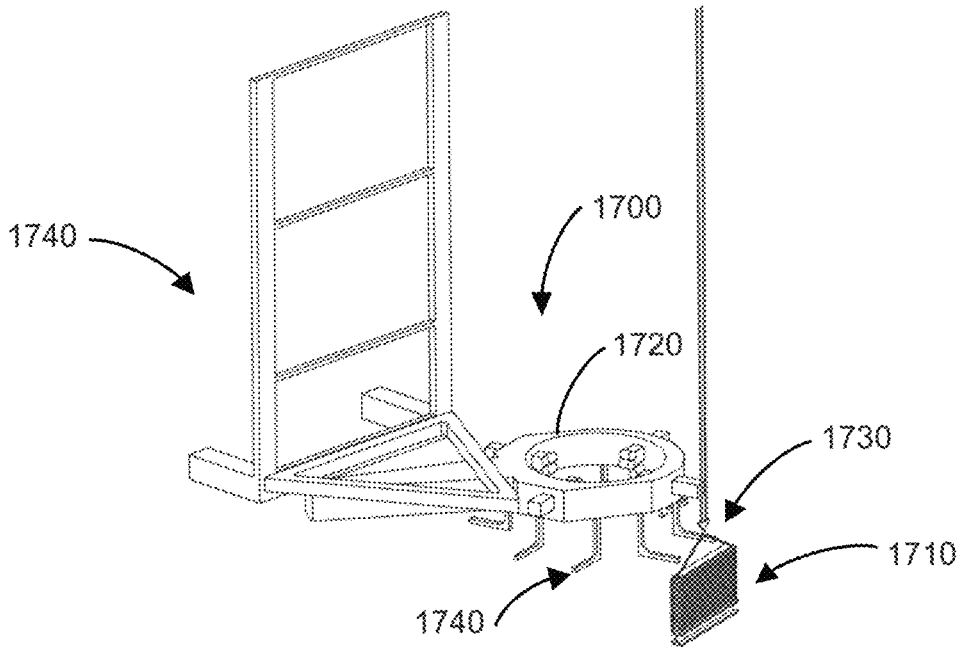
FIG. 17A illustrates a perspective view of hanging a stowed noise reduction panel on an annular articulating frame.
Figure 17B:
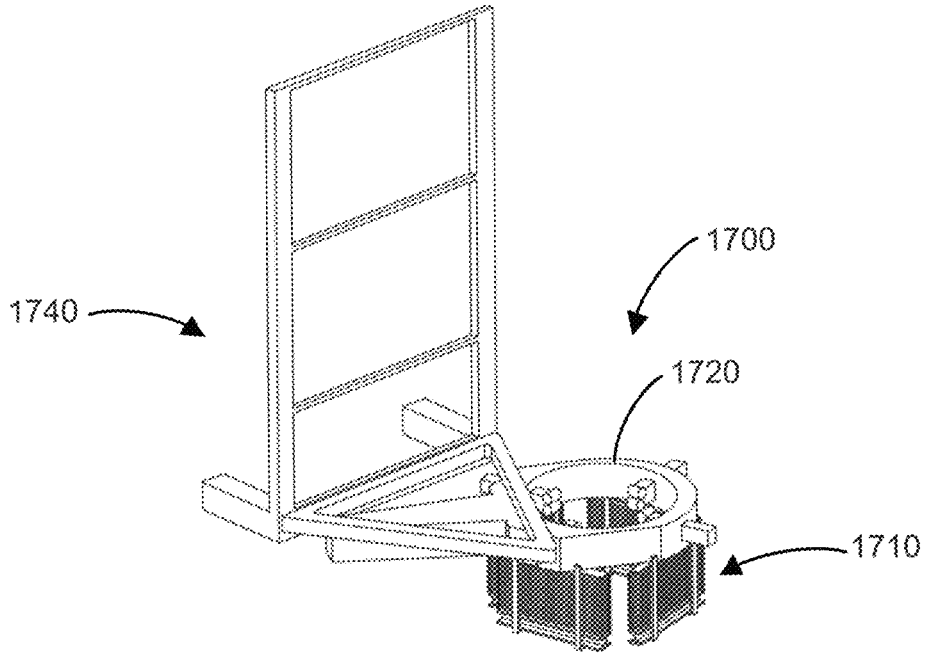
FIG. 17B illustrates a perspective view of a plurality of stowed noise reduction panels hanging on an annular articulating frame.
Figure 17C:
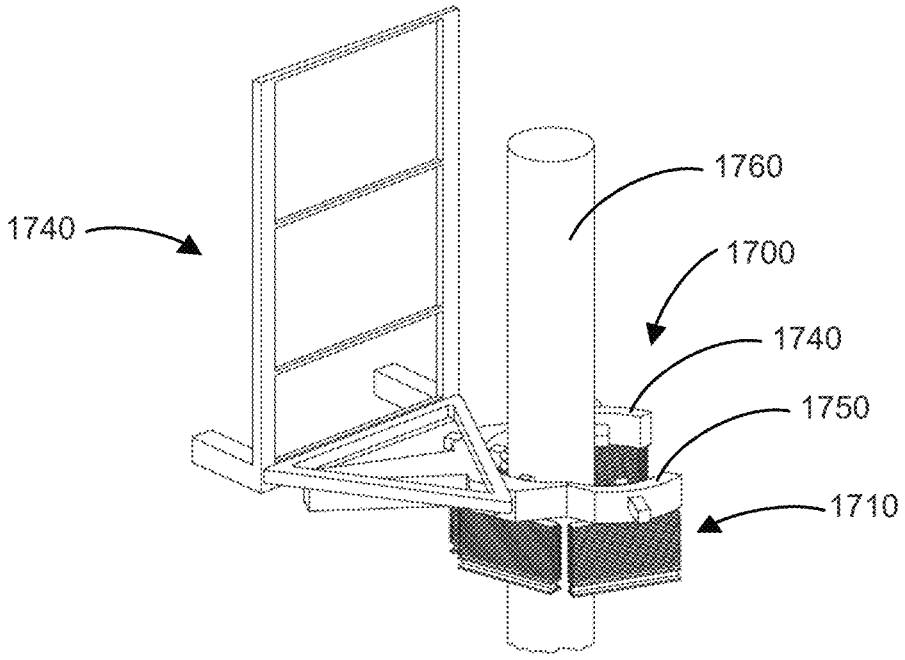
FIG. 17C illustrates a perspective view of a plurality of stowed noise reduction panels hanging on an annular articulating frame in an open position for mounting on a pile.
Figure 17D:
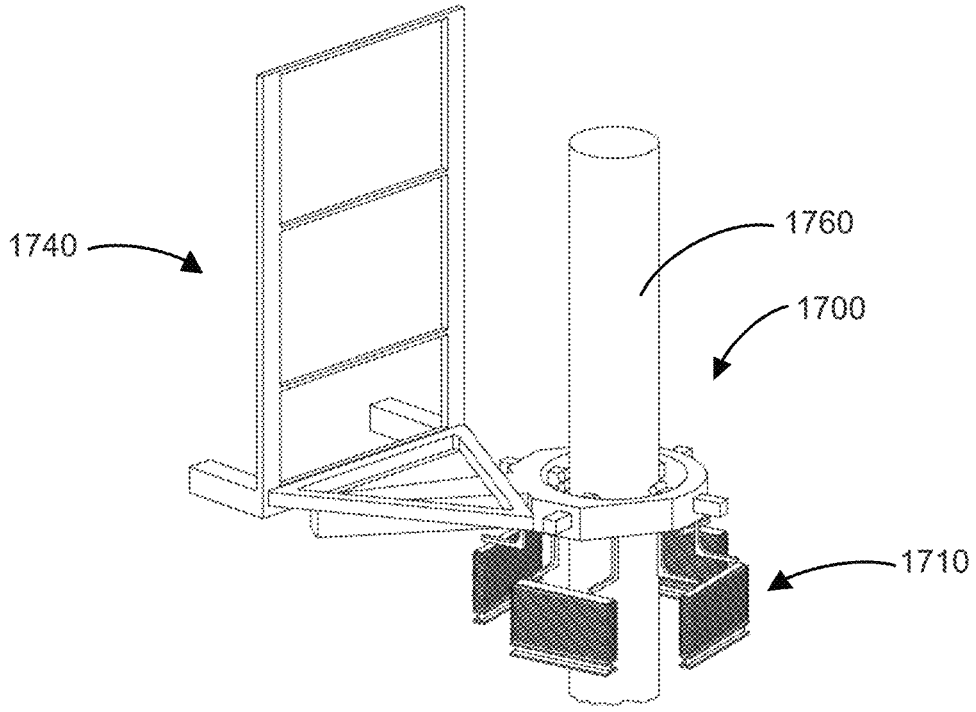
FIG. 17D illustrates the noise reduction apparatus of FIG. 17C with the annular articulating frame mounted on the pile.
Figure 17E:
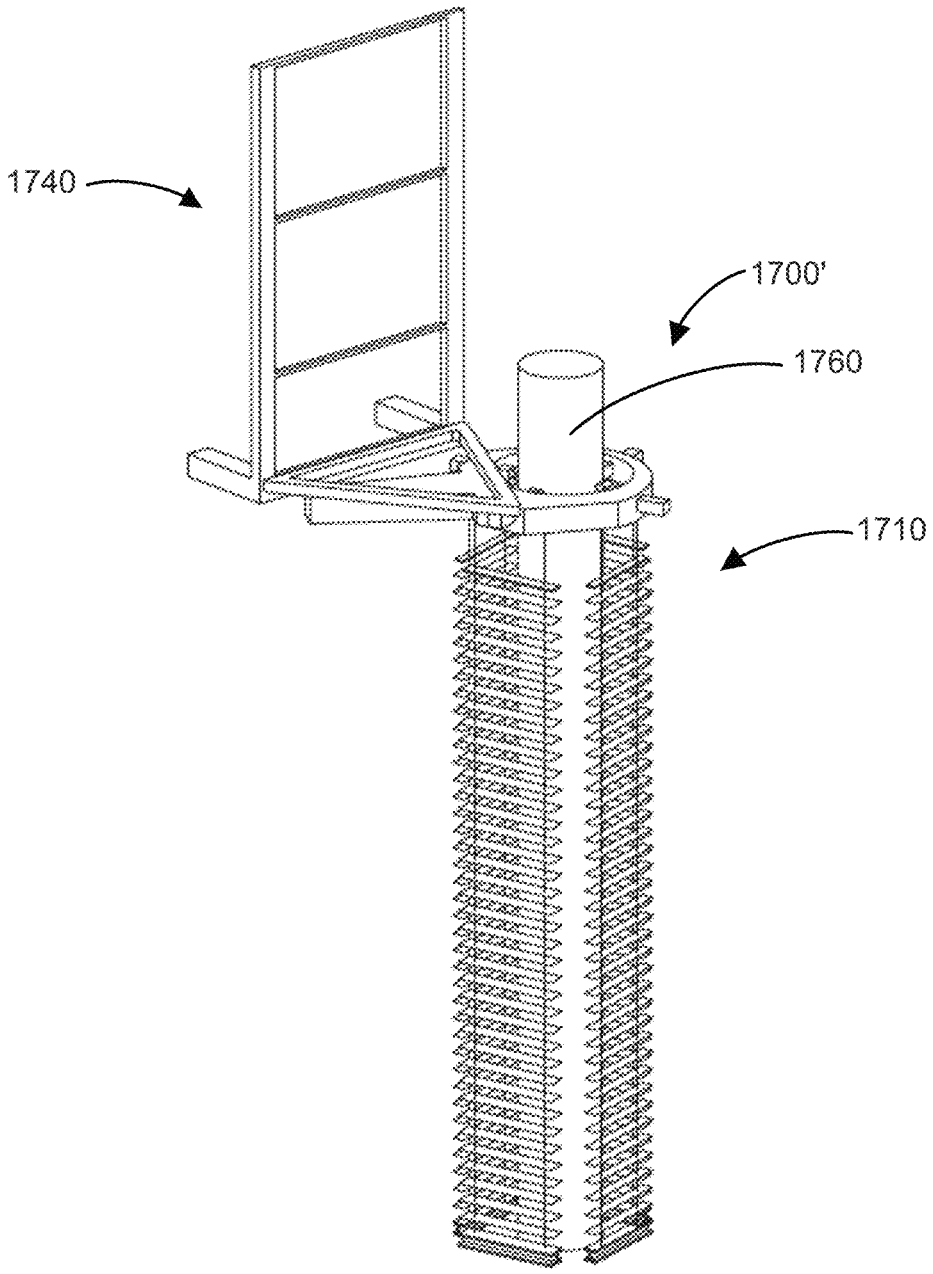
FIG. 17E illustrates the noise reduction apparatus of FIG. 17D in a deployed configuration.

FIGS. 17A-E illustrate a deployable noise reduction apparatus 1700 comprising noise reduction panels 1710 mounted on an annular articulating stowable frame 1720. As illustrated in FIG. 17A, the panels 1710 include a line 1730 for releasably hanging (e.g., by using a crane) the panels 1720 on brackets 1740 connected to the annular frame 1720. The apparatus 1700 allows the system to be customized in the field by interchanging the panels 1710 to select those best suited for a given application. The annular frame 1720 is connected to a secondary frame 1740, which can be mounted on a ship. In some embodiments, the panels 1710 are mounted on the annular frame 1720 after the annular frame 1720 has pivoted down to a deployed orientation as illustrated in FIGS. 17A-E. As illustrated in FIG. 17C, a first arm 1740 and a second arm 1750 of the annular frame 1720 can open like a claw to grip/receive a pylon 1760 or other support structure inside the annular frame 1720. After the pylon 1760 is inside the annular frame 1720, the first and second arms 1740, 1750 can close to mount the annular frame 1720 on the pylon 1760 (FIG. 17D). The noise reduction panels 710 are then lowered into a deployed configuration 1700' (FIG. 17E) as discussed above. The noise reduction apparatus 1700 provides an efficient and customizable structure for reducing noise proximal to a jackup rig or other vessel that includes a pylon.

Figure 18:
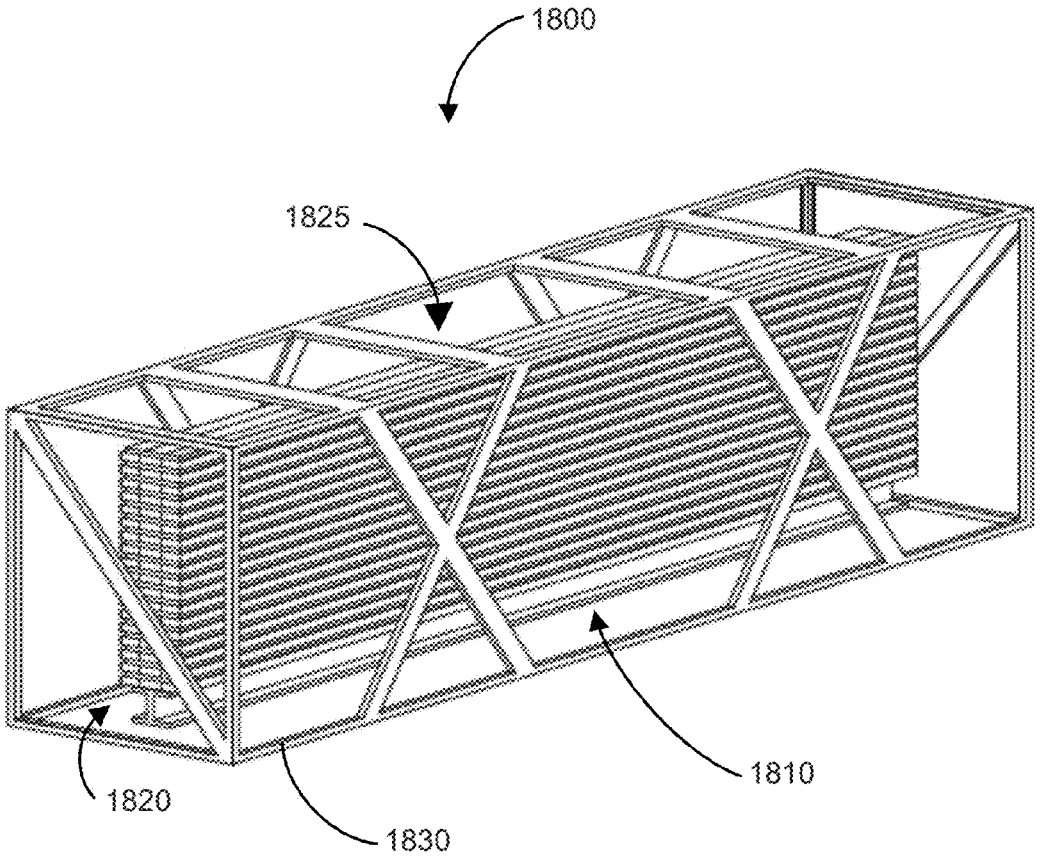
FIG. 18 illustrates a noise reduction apparatus disposed in a storage frame.

FIG. 18 illustrates an embodiment of a deployable noise reduction apparatus 1800. The apparatus 1800 includes a noise reduction panel 1810 mounted on an interior wall 1820 of a protective frame/enclosure 1830. The protective frame/enclosure 1830 surrounds the panel 1810 while the panel 1810 is in a folded or storage configuration as illustrated in FIG. 18. To deploy the apparatus 1800, a second wall 1825 is removed (e.g., opened or physically removed) so that the panel 1810 can be lowered to an unfolded or deployed configuration as discussed above. The protective frame/enclosure 1830 can protect the panel 1810 from damage during transportation. In addition or in the alternative, the protective frame/enclosure 1830 can provide a regular shape for transporting the apparatus 1800, for example, in a shipping container intermixed with other goods. The protective frame/enclosure 1830 can be made out of a plastic, corrosion-resistant metal, or similar material. In some embodiments, the protective frame/enclosure 1830 is a shipping container and the second wall 1825 is a removable and/or openable wall of the shipping container. For example, the noise reduction panel 1810 can be attached (e.g., semi-permanently or permanently attached) to the interior wall 1820 of the top of the shipping container and the bottom is openable and/or removable so that the noise reduction panel 1810 can be deployed.

Those skilled in the art will appreciate upon review of the present disclosure that the ideas presented herein can be generalized, or particularized to a given application at hand.

As such, this disclosure is not intended to be limited to the exemplary embodiments described, which are given for the purpose of illustration. Many other similar and equivalent embodiments and extensions of these ideas are also comprehended hereby.

What is claimed is:

1. A noise abatement system, comprising:

a plurality of noise abating resonators, each resonator holding a gas therein and being responsive to acoustic energy in a vicinity of said resonator;

said resonators arranged into a deployable arrangement within a collapsible frame so that said deployable arrangement provides a deployed configuration of said resonators in said frame when the system is deployed, and a stowed configuration of said resonators in said frame when the system is not deployed;

said deployed configuration having said frame in an extended position so that said resonators are spaced further apart from one another than they would be when stowed, and said stowed configuration having said frame in a contracted position so that said resonators are spaced closer together than they would be when deployed; and said frame including an upper cross member comprising a buoyant material that maintains the upper cross member separated and above a lower cross member of said frame when said system is deployed in water.

2. The system of claim 1, said resonators being arranged into a plurality of rows in said frame, each row having a common row support member coupled to resonators in said respective row.

3. The system of claim 2, said common row support member comprising a flexible material.

4. The system of claim 2, said rows being generally parallel to one another and each row being generally along a first dimension so that the frame generally lies in a plane defined by said first dimension and a second dimension orthogonal to said first dimension.

5. The system of claim 4, said second dimension being generally parallel to a direction of gravitational pull.

6. The system of claim 4, the plurality of resonators and rows generally defining a panel of resonators and the system further comprising multiple such panels of resonators, each panel of resonators lying generally in its own plane when deployed.

7. The system of claim 6, each panel mounted on an annular frame.

8. The system of claim 7, said annular frame is articulatable from an open position to a closed position.

9. The system of claim 8, said annular frame is mountable on a support structure.

10. The system of claim 2, said resonators being arranged into a plurality of columns in said frame, each column having a common column support member coupled to resonators in said respective column.

11. The system of claim 10, said common column support member comprising a flexible material.

12. The system of claim 2, the plurality of resonators and rows generally defining a panel of resonators, said panel of resonators disposed in a storage frame when said panel is in said stowed configuration, said storage frame including at least one removable wall so said panel can be deployed from said storage frame.

13. The system of claim 2, the plurality of resonators and rows generally defining a panel of resonators, said panel of resonators including a telescoping side support member.

14. A method for abating noise, comprising:

arranging a plurality of acoustic resonators in a flexible and deployable framework that can be configured in a deployed or in a stowed configuration;

extending a flexible frame of said framework into its deployed configuration by extending the flexible frame when said framework is deployed into a volume of water in which noise is to be abated, said frame having an upper cross member comprising a buoyant material that maintains the upper cross member separated and above a lower cross member of said frame when said framework is deployed in said water;

contracting said frame into its stowed configuration by compacting the flexible frame when said framework is to be stowed; and storing said deployable framework in a storage compartment when not deployed and when in its stowed configuration.

15. The method of claim 14, wherein arranging said plurality of acoustic resonators comprises arranging the resonators into a plurality of rows of resonators, each row of resonators being attached to a common row support member.

16. The method of claim 15, wherein extending said frame comprises spreading said rows of resonators apart so as to create a larger distance between each said row in the deployed configuration, and contracting said frame comprising compacting said rows of resonators onto one another so as to create a smaller distance between each said row in the stowed configuration.

17. The method of claim 14, wherein arranging said plurality of acoustic resonators comprises arranging the resonators into a plurality of columns of resonators, each column of resonators being attached to a common column support member.

18. The method of claim 15, further comprising forming a panel of resonators with said plurality of rows of resonators.

19. The method of claim 18, further comprising disposing said panel on an annular frame.

20. The method of claim 19, further comprising:

opening an articulatable portion of said annular frame;

disposing said annular frame on a support structure through an open portion of said annular frame; and closing said articulatable portion of said annular frame around said support structure.

21. An underwater noise abatement system for use in a marine environment, comprising:

a plurality of noise abating resonators, each resonator holding a gas therein when deployed in water and being responsive to acoustic energy in said water in a vicinity of said resonator;

said resonators arranged into a deployable arrangement within a collapsible frame so that said deployable arrangement provides a deployed configuration of said resonators in said frame when the system is deployed in water, and a stowed configuration of said resonators in said frame when the system is not deployed, said frame including an upper cross bar and a lower cross bar;

said deployed configuration having said frame in an extended position so that said resonators are spaced further apart from one another than they would be when stowed, and said stowed configuration having said frame in a contracted position so that said resonators are spaced closer together than they would be when deployed; and a deployment line connected to said upper cross bar and to a marine vessel, the deployment line supporting the upper cross bar to separate the upper cross bar from above said lower cross bar when said system is deployed in water.

* * * * *